US006101784A

United States Patent [19]

Schoen et al.

[11] Patent Number: 6,101,784

[45] Date of Patent: Aug. 15, 2000

[54] PRODUCT WRAPPING MACHINE

[76] Inventors: Jason C. Schoen; Raymond D. Ducorsky, both of Adpack, Inc. 7B Zane Grey, El Paso, Tex. 79506

[21] Appl. No.: 09/191,589

[22] Filed: Nov. 13, 1998

Related U.S. Application Data

[60] Provisional application No. 60/066,034, Nov. 14, 1997.

[51] Int. Cl.[7] ..... B65B 9/20; B65B 9/10; B65B 57/08

[52] U.S. Cl. ..... 53/45 D; 53/64; 53/51; 53/550; 53/567

[58] Field of Search ..... 53/542, 550, 567, 53/370.6, 51, 64, 459, 450

[56] References Cited

U.S. PATENT DOCUMENTS

| | | | |
|---|---|---|---|
| 3,347,015 | 10/1967 | Nutting | 53/370.6 |
| 3,388,526 | 6/1968 | Harm | 53/550 |
| 3,959,952 | 6/1976 | Deutchlander | 53/370.6 |
| 4,429,513 | 2/1984 | Beckers et al. | 53/550 |
| 5,109,654 | 5/1992 | Suga | 53/550 |
| 5,537,802 | 7/1996 | Orndorff | 53/550 |

FOREIGN PATENT DOCUMENTS

| | | | |
|---|---|---|---|
| 1059841 | 11/1953 | France | 53/550 |
| 8003992 | 2/1982 | Netherlands | 53/370.6 |

*Primary Examiner*—John Sipos

[57] ABSTRACT

Sealing and severing equipment for packaging articles like candy pieces and the like in flexible packaging sheet material. The equipment including a table extending between longitudinal and transverse sealing means where the bottom ends of sheet material draped over articles sequentially delivered to the table inlet are subsequently longitudinally sealed and then transversely sealed and severed at the opposite ends of the wrapped articles. A pair of horizontally spaced confronting conveyors are provided on opposite longitudinal sides of said table and carrying corresponding spaced pairs of confronting fingers to be moved along opposite sides of and along the length of said table. The confronting pairs of fingers deform the packaging material inward to an extent to be located behind an article to push the same on the table or in front of an article to limit forward movement thereof and thereby to define article confining spaces which assure the delivery of said packaging material encased articles properly positioned to said sealing and severing means to avoid crushing or damaging the articles and means for moving said conveyors to deliver sequentially said pairs of fingers to first position a pair of said fingers behind an article delivered to said table inlet to define the rear margin of an article confining space and to push the same forward along said table and then to position a pair of said confronting fingers in front of the article behind the latter article to limit its forward movement and to establish the front end of an article confining space.

9 Claims, 5 Drawing Sheets

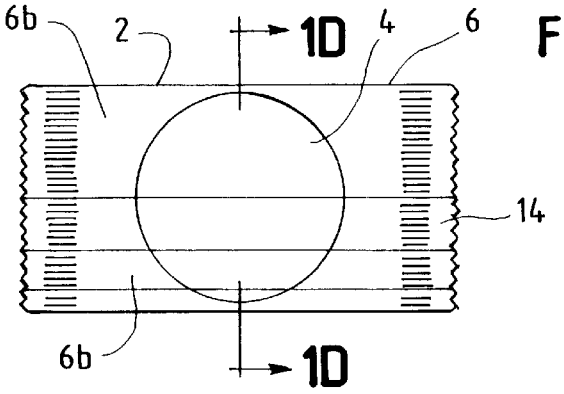
FIG. 1A
FIG. 1B
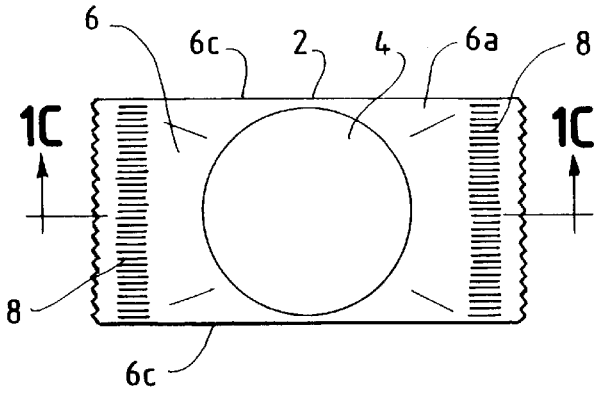
FIG. 1C
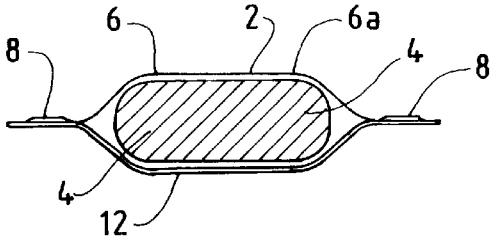
FIG. 1D
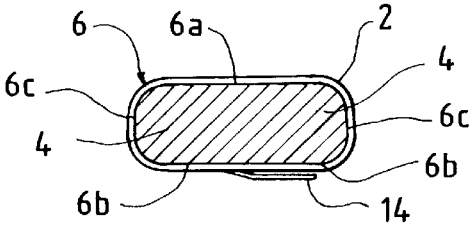

PRODUCT WRAPPING MACHINE

RELATED APPLICATION

This application is based on U.S. Provisional Application Ser. No. 60/066,034, filed Nov. 14, 1997.

TECHNICAL FIELD

This invention relates to a machine for wrapping of individual candy pieces or other similar articles in a wrapping of sheet material which is sealed around each piece at the ends and along the length thereof in a mass production process.

BACKGROUND OF THE INVENTION

The above referred to process, for example, preferably involves feeding the pieces to wrapping and sealing stations of the machine in equally spaced positions on an infeeding conveyor above which is fed at a higher speed a continuous strip of the sheet of wrapping material. The infeeding conveyor sometimes comprised a continuous belt or chain moved generally horizontally in an elongated continuous path in a vertical plane and carrying fingers engaging the rear ends of the pieces sliding along a horizontal slotted table. The fingers pushed the pieces to the sealing station of the machine where they then leave contact with the pieces. While the pieces to be wrapped are moved horizontally by these fingers along the slotted table to the sealing section of the machine the strip of sheet material is draped down over the sides of the pieces on the slotted table. The pieces with the sheet material draped along the sides thereof are then delivered by these fingers to the sealing station of the machine where the pieces to be Wrapped are then moved along the slotted table by the friction of the wrapping material pressing against the sides of the pieces, in some cases aided by inwardly spring-urged strips pressing the moving strip against the sides of the pieces to be wrapped.

At the inlet portion of the sealing station the longitudinally extending bottom margins of the strip of wrapping material are first brought together beneath the pieces to be wrapped where they are sealed together in any suitable way along their longitudinal margins, as by heat sealing where the strip is made of thermoplastic material. The wrapped pieces are then delivered by the forces applied to the pieces by the moving strip of sheet material pressing against the sides thereof to an end sealing and preferably also a sheet severing station where the then top and bottom layers of the continuous sheet of wrapping material are cross sealed together just beyond the opposite longitudinal ends of each piece. The cross sealer preferably comprises confronting top and bottom rotating drums carrying circumferentially spaced sealing and severing ribs which first cross seal and severe the sheet material at the front end of the leading piece delivered thereto and then cross seal and severe the sheet material at the rear end of the latter piece.

In order for the prior art wrapping machines to reliably deliver the partially wrapped pieces to the cross sealing station just described, the pieces must be properly spaced on the slotted table or the cross sealing and severing ribs could smash the pieces delivered thereto. The frictional forces of the inwardly pressed sides of the sheet of wrapping material maintained such proper spacing reliably only if the speed of the movement thereof was severely limited. Otherwise the pieces could readily shift longitudinally on the slotted table to a point where the cross sealing and severing ribs described would contact and crush the improperly positioned pieces.

SUMMARY OF THE INVENTION

In accordance with the invention, a unique means is provided for always properly positioning the pieces to be wrapped on the slotted table or other support surface of the sealing station of the machine, so that faster reliable machine speeds can be achieved. This unique means is most preferably a pair of continuously rotated confronting, horizontally spaced finger-carrying conveyors or belts quite different in their function and structure from the single infeeding conveyor. These pair of conveyors bring laterally aligned pairs of sequentially in position first behind each candy piece delivered to the inlet of the sealing station to define the rear margin of a candy piece-confining space and then in front of the next candy piece delivered thereto to define the front margin of a candy piece-confining space for this next candy piece. Each pair of fingers loosely pushes the wrapping material inward to be located behind or in front of the candy piece involved. With such a candy-positioning system, the pieces involved are confined to positions where the rotating sealing and severing ribs cannot possibly engage and smash the same, even at very high machine speed.

These pocket size-defining fingers are most advantageously moved at a somewhat higher speed that the speed at which the candy pieces are moved by the individual unpaired fingers of the infeeding conveyor. In such case, the candy pieces on the infeeding conveyor are spaced closer together than they are when they are positioned by the pairs of candy-positioning fingers moved to the sealing station. Depending on the speed of the paired fingers, the length of the candy-confining pockets can be varied somewhat to assure that the end sealing operation performed on the wrapping material does not wrap the candy too tightly where the candy pieces could be crushed or broken.

Also, because these pairs of fingers loosely position the candy pieces through the wrapping material the speed of the wrapping material and fingers can be varies with respect to each other. This is especially important when the packaging material has a label pre-printed thereon and it is necessary to adjust the position of the wrapping material relative to the candy pieices so that the label printed thereon is properly centered or otherwise desirably positioned on the finally wrapped candy pieces.

One prior art product wrapping machine not as suitable as the present invention for wrapping candy pieces is disclosed in British Patent No. 1,444,277 granted in the 1970's. This machine is used to wrap groups of biscuits in a manner similar in some respects to but much different in other respects from the way in which the candy pieces are handled in the present the invention. In this British machine, instead of moving individual successive pairs of fingers sequentially in place to first define the rear margin and then the front margin of successive article-confining spaces, double ended pairs of spring members are moved simiultaneously between successive groups of biscuits and at the same speed as the groups of biscuits are delivered to the sealing station. One of the corresponding ends of these pairs of spring members define the rear end of a confining space for one group of biscuits and the other corresponding ends of the pair of spring members involved defines the front end of the trailing group of biscuits. This method of forming the article-confining spaces does not result in as loose a positioning of the candy or permit as close a control over the size of the article-confining spaces as does the present invention, which is more suitable for wrapping candy pieces than the wrapping method of this British patent.

In summary, the various aspects of the present invention has the ability to avoid risk of article damage, to provide for variations in product size and shape and to adjust label position without sacrificing a high machine speed.

DESCRIPTION OF DRAWINGS

FIGS. 1A and 1B respectively are bottom and top views of the candy pieces shown in the other Figures of the drawings:

FIGS. 1C and 1D respectively are longitudinal and transverse cross-sectional views of the candy piece shown in FIGS. 1A and 1B, as seen respectively along section planes 1C—1C and 1D—1D in FIGS. 1B and 1A;

DESCRIPTION OF MACHINE AND ITS OPERATION AS SHOWN IN DRAWINGS

Figure 2:
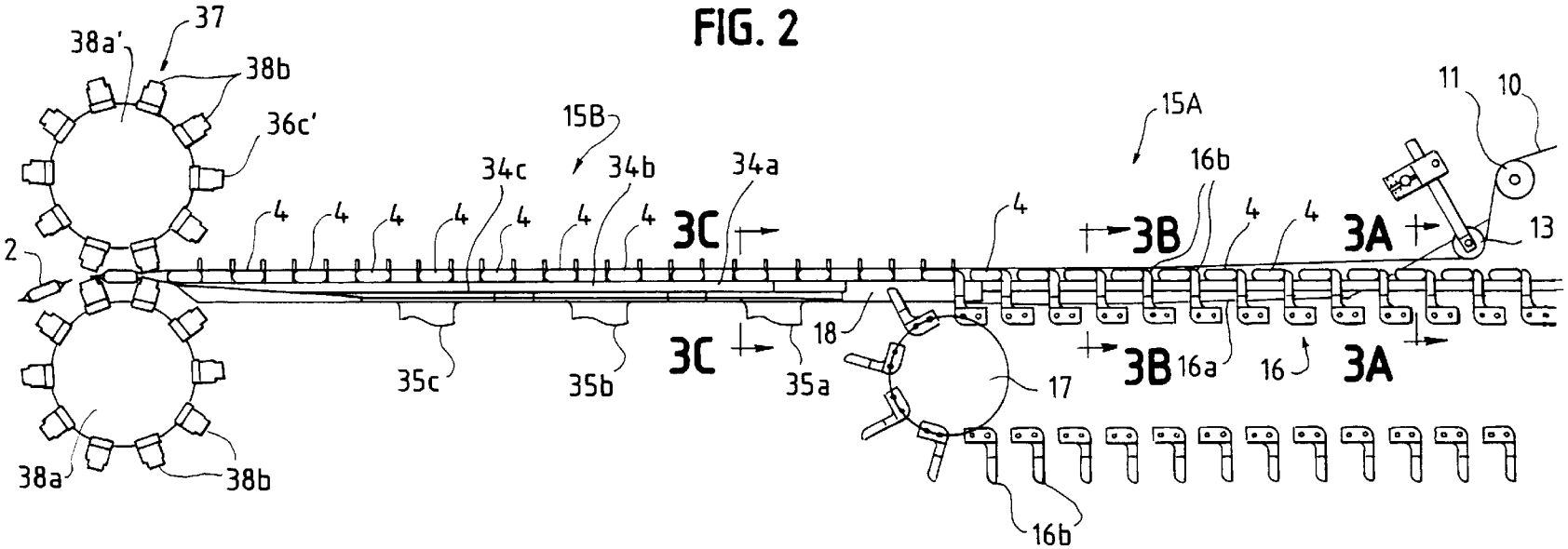
FIG. 2 is a side elevational view of the preferred machine of the invention which wrapped with transparent sheet material the candy piece shown in FIGS. 1A–1D (shading lines on the sheet material which would normally be placed on all Figures have been eliminated to avoid obscuring the view of the candy pieces and machine details within or behind the packaged pieces)

Referring now to FIGS. 1A–1D where there is shown candy piece package 2 formed by the machine of the invention. The package includes as illustrated a disc-shaped circular candy piece 4 with circular rounded sides and flat top and bottom surfaces. However, the candy piece wrapped by the machine of the invention can have any shape. AS illustrated, the candy piece is surrounded and sealed by a wrapping of transparent sheet material 6 having a continuous elongated rectangular top wall 6*a* joining longitudinal side walls 6*c*—6*c* (FIG. 1D) which join elongated rectangular bottom wall portions 6*b*—6*b* sealed together to form a longitudinal sealing flap 14. The opposite longitudinal ends of the top and bottom walls os the wrapping 6 are secured together by cross sealed portions 8—8 which together with the longitudinal sealing flap 14 forms a sealed package for the candy piece 4.

The machine of the invention is shown in FIG. 2 to which reference is now made. It includes a candy and packaging material inlet section 15A in which a strip 10 of transparent packaging material is fed above an infeeding conveyor 16 which feeds candy pieces 4 on a slotted table 18 to the inlet end of a sealing and severing section 15B of the machine. As illustrated in FIG. 2, the infeeding conveyor is a chain conveyor carrying equally spaced pusher fingers 16*b* fed in a continuous path in a vertical plane. The forward end of the chain conveyor passes around a sprocket wheel 17. The upper section 16*a* of the chain conveyor carries the fingers 16*b* though a longitudinal slot in the table 18 where the fingers push the candy pieces along the table 18. If the candy pieces had a spherical shape, to prevent free rolling of the pieces the infeeding conveyor would have to be provided with suitable carrier pockets or other means to prevent or constrain the rolling of the candy pieces. The spacing between each successive pair of pusher fingers 16*b*—16*b* as illustrated which are spaced apart a distance slightly greater than the diameter of the disc-shaped candy pieces in effect would form such pockets for spherically shaped candy pieces if the machine were used for this purpose.

Figure 3A:
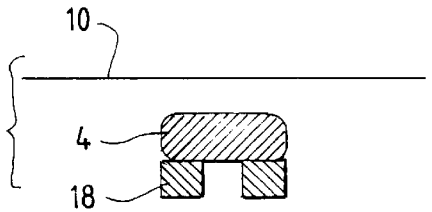
FIGS. 3A, 3B and 3C respectively are transverse cross-sectional views through the machine shown in FIG. 2 at points thereof showing respectively the positions of the continuous strip of sheet material relative to the candy pieces before and during the candy wrapping and sealing operations as would be seen along section planes 3A—3A, 3B—3B and 3C—3C in FIG. 2.
Figure 3B:
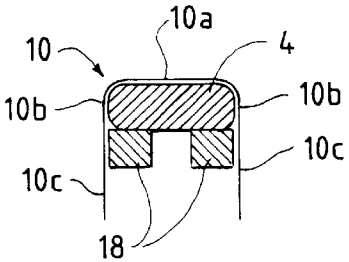

The strip of sheet material 10 passes over and around rollers 10 and 11 so that the sheet material which is initially wholly above the candy pieces 4 as shown in FIG. 3A is folded down to be draped on opposite sides of the candy pieces, as shown in FIG. 3B. The top side 10*a* of the draped strip then rests on the top faces of the candy pieces below and the sides 10*b*—10*b* of the strip are located close to the sides of the candy pieces and the slotted table 18; as shown in FIG. 3B. As in the manner carried out in prior art machines not shown in the drawings, the sides of the strip 10 are then folded under the candy pieces 4 so portions of the strip 10 immediately underlie the candy pieces as shown in FIG. 3C using suitable folding means well known in the prior art.

Figure 3C:
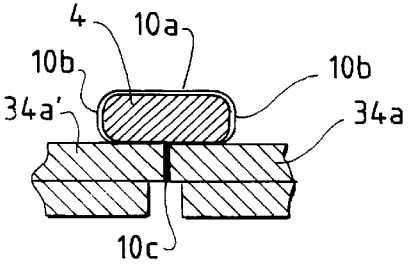

The sealing section 15B of the machine includes three pairs 34*a*–34*a*', 34*b*–34*b*' and 34*c*–34*c*' of longitudinal sealing means located at the same elevation as the table 18 as best shown in FIG. 3C. The ends 10*c*—10*c* (FIG. 3B) of the initially draped strip of wrapping material 10 are brought together initially between the first pair of sealing drums 34*a*–34*a*' which forms the beginning of the longitudinal sealing flap 14 shown in FIGS. 1A and 1D. The other pairs of sealing drums 34*b*–34*b*' and 34*c*–34*c*' complete the formation of this flap which forms an effective longitudinal seal along the strip 10.

The machine as just described is like some machine designs of the prior art. The present invention deals wholly with the manner in which the candy pieces 4 are moved and positioned along the candy piece support surface in the sealing section 15B of the machine, so that they occupy definite equally spaced positions therealong. Then, when the partially wrapped candy pieces are delivered to a cross sealing and severing station 37 at the end of the sealing section 15B of the machine the candy pieces are not damaged by the parts of the machine thereat to be described.

This unique candy piece moving and positioning means comprises a horizontally spaced pair of confronting conveyors 19–19' including belts 20–20' which carry equally spaced pairs of candy piece pocket-forming fingers 22–22' above the candy piece supporting table 18. The belts 20–20' pass over respective roller pairs 24–24', 26–26', 28–28', 30–30' and 32–32' of. All rollers but the rollers 28–28' are idler rollers. The rollers 28–28' are feed rollers having peripheral slots into which pass the fingers 22–22' of the belts 20–20' pass. The fingers 22–22' in these slots drive the belts 20–20' to which the fingers 22–22' are attached.

Figure 5A:
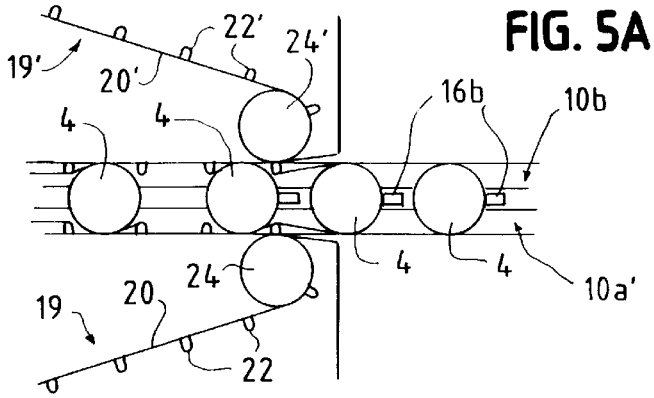
FIGS. 5A–5D show in sequence the different positions of the candy piece-pushing and confining pocket-forming fingers of the sealing section of the machine as the candy pieces are transferred from an infeeding conveyor to this sealing section.
Figure 5B:
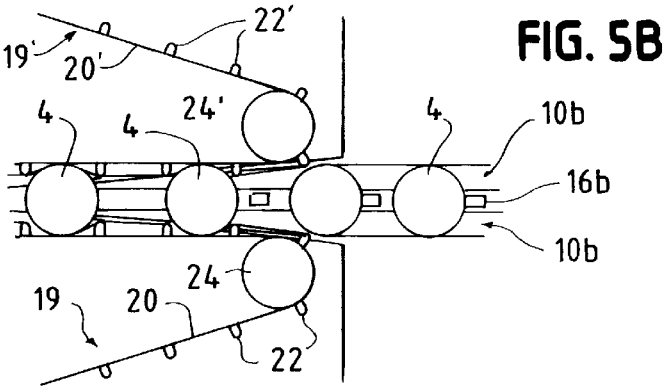
Figure 5C:
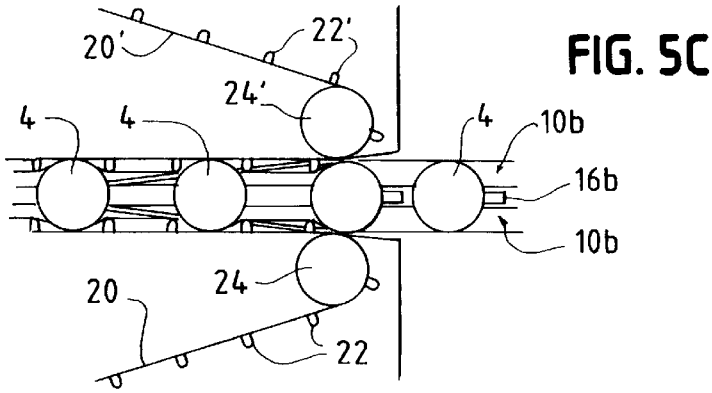
Figure 5D:
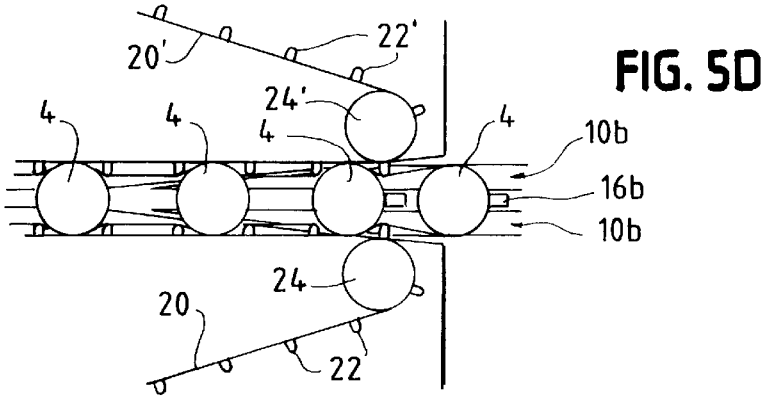
Figure 6A:
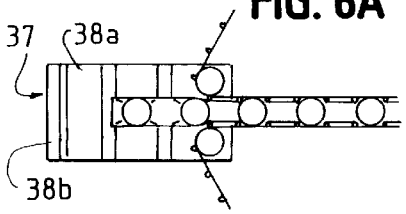
FIGS. 6A, 6B, 6C and 6D respectively show a plan view above the lower rotating drum of the cross sealing and severing station of the machine for different sequential positions of the drum carrying the rotating cross sealing and severing ribs and the sheet material wrapped candy pieces delivered thereto.
Figure 6B:
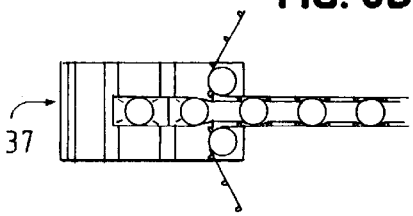
Figure 7A:
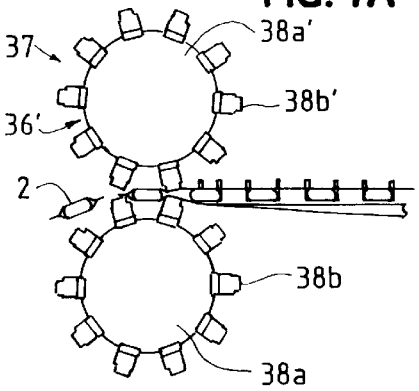
FIGS. 7A, 7B, 7C and 7D show respectively a side elevational view of the cross sealing and severing station of the machine corresponding respectively to the positions of the machine parts and candy pieces shown in FIGS. 6A, 6B, 6C and 6D.
Figure 7B:
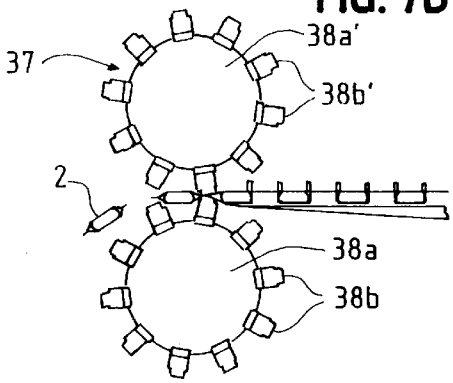
Figure 6C:
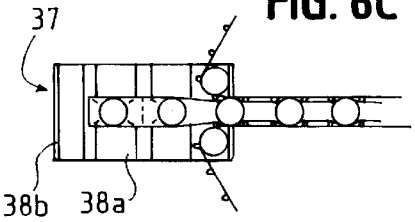
Figure 6D:
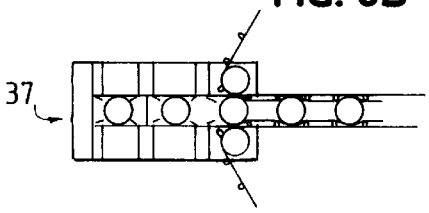
Figure 7D:
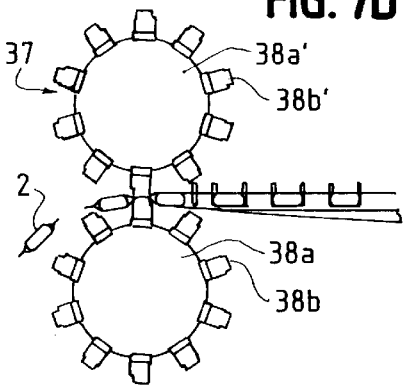
Figure 7C:
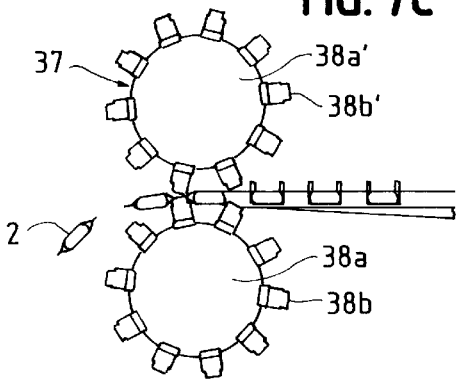

The candy piece pocket-forming fingers 22–22' are moved at a faster rate than are the pusher fingers 16*b* of the infeeding conveyor 16. As best shown in FIGS. 5A–5B, as a pushing finger 16*b* of the infeeding conveyor moves a candy piece to the inlet end of the sealing and severing section 15B of the machine, a pair of the candy piece pocket-forming fingers 22–22' moving at a higher speed than the infeeding conveyer pushing fingers 16*b* are moved behind a candy piece 4 to deform inwardly the sides of the strip of wrapping material 10 thereat to form the rear end of a candy piece pocket. These pair of fingers 22–22' so positioned will generally also act as pushing fingers for the candy piece ahead of them.

The next pair of fingers 22–22' brought into place to deform the strip of wrapping material inward preferably does so in front of the next candy piece delivered by a pushing finger 16*b* of the infeeding conveyor 16, to form the front end of a candy piece positioning pocket for the latter candy piece. In this manner equally spaced candy piece positioning pockets are formed so that each candy pieces will be properly positioned for safe delivery to the cross sealing and severing station elements now to be described.

Figure 4:
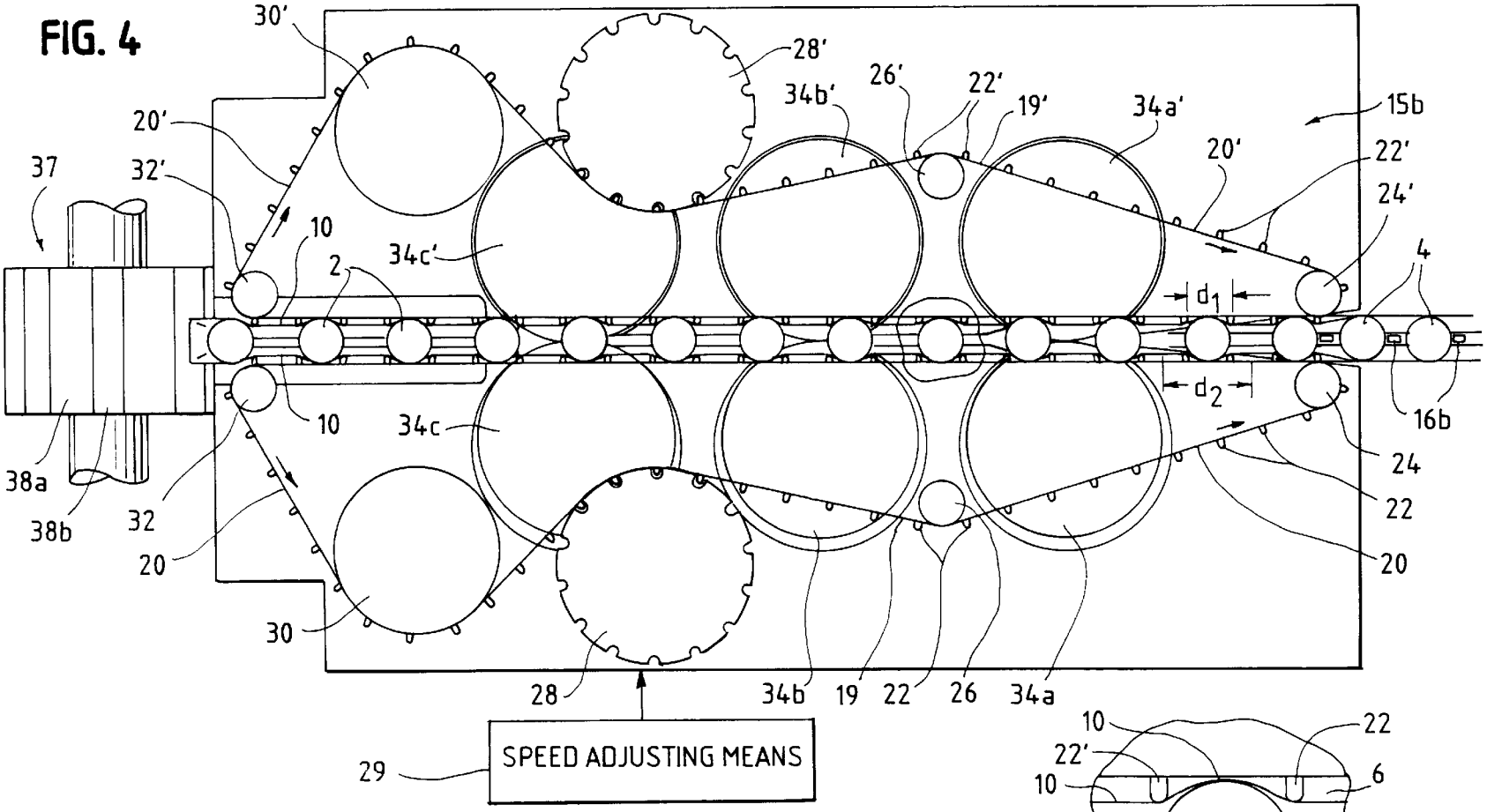
FIG. 4 is an enlarged plan view of the sealing and severing stations of the machine shown in FIG. 2.
Figure 4A:
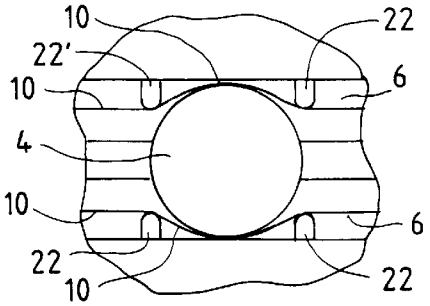
FIG. 4A is an enlarged view of a portion of the machine shown in FIG. 4 as seen within cut-out line L in FIG. 4.

This sealing and severing station 37 shown in FIGS. 4 and 4A and in FIGS. 6A–6D and 7A–&D includes confronting top and bottom rotating drums 38*a*'–38*a*. These drums carry circumferentially spaced sealing and severing ribs 38*b*–38*b*' which are moved in confronting pairs together to first cross seal and severe the sheet material 10 sealed around the candy pieces at the front end of the leading candy piece delivered thereto and then cross seal and severe the sheet material at the latter end of the latter piece. FIGS. 6A–6D and FIGS. 7A–&D best show the sequential positions of these ribs and the candy pieces delivered thereto which deliver separated sealed and wrapped candy piece packages to the outlet end of the machine.

If it is desired to shift the position of a label on the packaging material with respect to the articles being packaged (whose position is determined by the position of the pairs of articles-pushing fingers 22–22' behind each article) a speed adjusting means shown by box 29 in FIG. 4 will adjust the feed speed of either the packaging material or finger-carrying conveyors to do so.

While the present invention has its most important application in the packaging of individual pieces of candy, it also can be used to package other individual articles at speeds substantially greater than packaging devices of which the applicant is aware.

What is claimed is:

1. In a machine for wrapping an articles like pieces of candy of the like with flexible sheet material, said machine including sealing and severing equipment having an inlet, an infeeding conveyor section for delivering said articles one at a time to said inlet of said packaging material sealing and severing equipment with a strip of said sheet material draped down over the sides of said articles;

said sealing and severing equipment having longitudinal seal forming stations for first longitudinally sealing beneath each article the longitudinal side margins of the sheet material previously draped down over the sides of said articles delivered to said inlet to surround said articles with said sheet material, a transverse seal forming and severing station for forming at each end of the wrapped articles a transverse seal between the top and bottom faces of the longitudinally sealed sheet of material then surrounding said articles and for transversely severing the sheet of material at the transversely sealed ends thereof to form individually separated and wrapped articles, and a table extending between said inlet and said longitudinal and transverse sealing and severing stations and upon and along which table the articles with the sheet material thereabout are to be moved therebetween, a pair of horizontally spaced confronting conveyors on opposite longitudinal sides of said table, said pair of conveyors carrying corresponding pairs of confronting projections spaced across the table and to be moved along opposite sides of and along the length of said table to deform the packaging material inward to an extent to define article confining spaces which are intended to assure the delivery of said sheet of packaging material encased articles in a proper position to said transverse seal forming and severing station to avoid crushing or damaging said article, and means for moving said conveyors to deliver sequentially said pairs of projections to first position a pair of said projections behind a first given article delivered to said inlet to define the rear margin of a first article confining space and then to position a pair of said confronting projections in front of the next article to prevent further forward movement thereof and to define the front end of the next article confining space; the improvement wherein:

said pairs of projections are of a size that they loosely deform the wrapping material inward so that the pairs of projections which are brought immediately behind the articles, not the moving packaging material, provide the force which moves the articles forward and means for feeding said sheet material at a speed different from the speed at which said confronting pair of projections are moved to adjust the positioning of any printed material on the sheet material with respect to the center of separated packaged articles.

2. The wrapping machine of claim 1 wherein there is provided means for moving said pair of confronting conveyors and the projections carried thereby at a lineal speed greater than the speed at which the articles to be packaged are delivered to said inlet by said infeeding conveyor.

3. Sealing and severing equipment for packaging articles like candy pieces and the like in flexible packaging sheet material where the articles are delivered in longitudinally spaced relation sequentially to the inlet of said equipment with a continuous strip of said sheet material draped over the articles and to be moved therewith, said equipment including a table upon which the articles are to be pushed extending between longitudinally spaced sealing means where the ends of the draped sheet material are to be longitudinally sealed beneath the articles, and transverse seal forming and severing means for sealing the top and bottom portions of the packaging sheet material between the longitudinally sealed ends of the articles, and a pair of horizontally spaced confronting conveyors on opposite longitudinal sides of said table, said conveyors carrying corresponding pairs of confronting projections spaced across the table and to be moved along opposite sides of and along the length of said table to deform the packaging material inward to an extent to define article confining spaces which are intended to assure the delivery of said of packaging material encased articles in a proper position to said transverse seal forming and severing station to avoid crushing or damaging said article, and means for moving said conveyors to deliver sequentially said pairs of projections to first position a pair of same behind a first given article delivered to said inlet to define the rear margin of a first article confining space and then to position a pair of said confronting projections in front of the next article to prevent further forward movement thereof and to define the front end of the next article confining space; the improvement wherein:

said pairs of confronting projections are of a size that they loosely deform the moving wrapping material inward so that the pairs of projections brought immediately behind the articles, not the moving packaging material, supplies the force to push the articles forward along said table and means for feeding said sheet material at a speed different from the speed at which said confronting pair of projections are moved to adjust the position of any printed material on the sheet material with respect to the center of separated packaged articles.

4. The sealing and severing equipment of claim 2 wherein said confronting conveyors move in horizontal continuous paths of an elongated oval shape with straight longituinal margins one of which extends along the length of said table so that pairs of confronting projections are brought inward against the sheet material draped with said sheet material at said inlet.

5. The wrapping machine of claim 1 wherein said pairs of projections are straight fingers which when moved along said table extend in opposite parallel directions extending laterally across said table.

6. The sealing and severing equipment of claim 2 wherein there is provided means for moving said pair of confronting conveyors and the projections carried thereby at a lineal speed greater than the speed at which the articles to be packaged are delivered to said inlet.

7. The sealing and severing equipment of claim 3 wherein said pairs of projections are straight fingers which when moved along said table extend in opposite parallel directions extending laterally across said table.

8. A method of wrapping and sealing articles like candy pieces and the like in flexible packaging sheet material using wrapping and sealing equipment having an inlet to which articles are delivered in longitudinally spaced relation sequentially to the inlet thereof with a continuous strip of said sheet material draped over and moved with the articles, said equipment including a table upon which the articles are to be pushed extending between longitudinally spaced sealing means where the ends of the draped sheet material are to be longitudinally sealed beneath the articles, and transverse seal forming and severing means for sealing the top and bottom portions of the packaging material between the longitudinally sealed ends of the articles, and a pair of horizontally spaced confronting conveyors on opposite longitudinal sides of said table, said conveyors carrying corresponding pairs of confronting article-pushing projections spaced across the table and to be moved along opposite sides of and along the length of said table to deform the packaging material inward to an extent to define article confining spaces which are intended to assure the delivery of said of packaging material encased articles in a proper position to said transverse seal forming and severing station to avoid crushing or damaging said articles, said projections being of a size and flexibility that they loosely deform the wrapping material inward so that the projections not the moving packaging material provide the force which pushes the articles along said table and so that the relative speed of the moving packaging sheet material and pairs of projections can, if desired, be varied with respect to each other, so that a label printed thereon can be centered or otherwise desirably positioned on the finally wrapped articles, and means for moving said conveyors to deliver sequentially said pairs of projections to first position a pair of same behind a first given article delivered to said inlet to define the rear margin of a first article confining space and then to position a pair of said confronting projections in front of the next article to prevent further forward movement thereof and to define the front end of the next article confining space; a method of operating said equipment, said method comprising the steps of:

delivering said articles one at a time in sequence to the inlet of said equipment and moving said strip of packaging sheet material along said table as said equipment conveyor and sealing stations perform said aforesaid article pushing and sheet material sealing functions; and shifting the position of the packaging material with respect to said articles to position said label by adjusting the relative speed of movement of said conveyors carrying said article pushing projections and said strip of packaging material to do so.

9. The sealing and severing equipment of claim 3 wherein said conveyor-carrying projections are equally spaced along said conveyor.

* * * * *